United States Patent [19]

Shigley et al.

[11] Patent Number: 5,028,311

[45] Date of Patent: Jul. 2, 1991

[54] DELAYED COKING PROCESS

[75] Inventors: John K. Shigley, Ogden, Utah; Keith M. Roussel, Ponca City; Steve D. Harris, Ponca City, both of Okla.

[73] Assignee: Conoco Inc., Ponca City, Okla.

[21] Appl. No.: 509,103

[22] Filed: Apr. 12, 1990

[51] Int. Cl.[5] ..... C10G 9/14

[52] U.S. Cl. ..... 208/131; 208/50; 208/125

[58] Field of Search ..... 208/50, 125, 131

[56] References Cited

U.S. PATENT DOCUMENTS

| | | | |
|---|---|---|---|
| 2,062,254 | 11/1936 | Atwell | 208/131 |
| 4,075,084 | 2/1978 | Shripek et al. | 208/50 X |
| 4,720,338 | 1/1988 | Newman et al. | 208/50 X |
| 4,758,329 | 7/1988 | Newman et al. | 208/131 |
| 4,822,479 | 4/1989 | Fu et al. | 208/131 |

*Primary Examiner*—Curtis R. Davis
*Assistant Examiner*—William C. Diemler
*Attorney, Agent, or Firm*—C. R. Schupbach

[57] ABSTRACT

Premium coke having a low coefficient of thermal expansion and containing reduced fluff coke is obtained by subjecting an aromatic mineral oil to reduced temperature delayed coking, thereafter converting uncoked oil in the coke drum to coke under delayed coking conditions by continuing coking in the presence of a aromatic mineral oil capable forming coke admixed with a non-coking material circulated through the coke drum as a heating fluid. After termination of the heating fluid, the coke in the coke drum is subjected to a heat soak in the presence of a non-coking material at an elevated temperature preferably above the delayed coking conditions.

24 Claims, 3 Drawing Sheets

DELAYED COKING PROCESS

BACKGROUND OF THE INVENTION

There is an increasing demand for high quality premium coke for the manufacture of large graphite electrodes for use in electric arc furnaces employed in the steel industry. The quality of premium coke used in graphite electrodes is often measured by its coefficient of thermal expansion (CTE) which may vary from as low as −5 to as high as +8 centimeters per centimeter per degrees centigrade times 10−7. Users of premium coke continuously seek graphite materials having lower CTE values, where the lower the CTE the higher the coke quality. Even a small change in CTE can have a substantial effect on large electrode properties. Another property which is of importance in characterizing the quality of graphite electrodes is density. The higher the density the better the electrode quality.

Premium coke is manufactured by delayed coking in which heavy hydrocarbon feedstocks are converted to coke and lighter hydrocarbon products. In the process the heavy hydrocarbon feedstock is heated rapidly to cracking temperatures and is fed continuously into a coke drum. The heated feed soaks in the drum and its contained heat which is sufficient to convert it to coke and cracked vapors. The cracked vapors are taken overhead and fractionated. The fractionator bottoms are recycled to the feed if desired. The coke accumulates in the drum until the drum is filled with coke, at which time the heated feed is diverted to another coke drum while the coke is removed from the filled drum. After removal, from the drum, the coke is calcined at elevated temperatures to remove volatile materials and to increase the carbon to hydrogen ratio of the coke.

It is desirable to operate the delayed coking process at low temperatures to enhance the development of the intermediate crystalline phase (mesophase) which results from the coking process. The more developed the mesophase prior to solidification of the coke the more crystalline is the final product, and in general, the lower the final product CTE. A major problem which is encountered when carrying out delayed coking at lower temperatures is the presence of unconverted feed or partially formed mesophase in the coke drum at the end of the coking process.

The feedstocks used for premium coke production typically produce between 20 and 45 weight percent coke. In general, about 50% or more of the feedstock in the liquid phase at coking conditions. The total vapor flow through the coke drum from the feed is significantly less than that produced by the same liquid volume rate of a material which is 100% vapor at coking conditions. A number of references discuss the use of a heat treating step wherein the delayed coking process is followed by contacting the coke with a non-coke forming material which is in the vapor state at the coking conditions employed. The prior art very clearly teaches that non-coking materials must be used. When this type of process is used a high vapor flow rate is required to maintain the coking temperature in the coke drums. As a result the unconverted feed and partially formed mesophase which are in the coke drum at the time of the switch from coking feed to non-coking vapor, is converted to foam. In turn, the foam is converted into a low density macroporous "fluff" coke at the end of the coking cycle. Fluff coke is very frangible and generates a large amount of fines when it is drilled out of the coke drum, during initial sizing and during calcination. The fine particles formed from fluff coke which "pass" through the calcination have a very low density and very little "needlelike" character. These characteristics create problems when the fluff coke particles are included in mixtures used for the manufacture of graphite electrodes because they significantly increase the pitch requirements. When insufficient pitch is provided, weak spots are created in the electrode by the fluff coke particles. The fluff coke also decreases the profitability of the premium coking operation by reducing the net production of coke. The low density fluff coke takes up much more volume in the coke drum per unit weight of coke.

It would be desirable to provide a delayed coking process which is carried out at a low temperature, and which utilizes a heat soak step, but at the same time, provides a premium coke product having a low CTE and substantially reduced in fluff coke content.

THE PRIOR ART

U.S. Pat. No. 4,547,284 discloses a premium coking process wherein coking is carried out at lower than normal temperatures and the resulting coke is heat soaked at a temperature higher than the coking temperature, preferably at least 32° F. higher.

U.S. Pat. No. 3,547,804 discloses the use of a mixture of pyrolysis tar and a non-coke forming distillate as a diluent to reduce the rate of coke formation during the drum fill cycle. The fill cycle is followed by a heat treat or "coking" cycle at elevated temperatures using the non coke forming distillate to maintain coke drum temperatures.

European Pat. Application 155,163 discloses temperature soaking or drying out of coke. Three procedures are described (1) raising the drum temperature while the coke is forming, particularly during the latter stages of the coke formation, (2) after the coke is formed by shutting off the fresh feed portion of the charge to the coke drum and recycling coker products or a portion thereof as hot vapor through the already formed mass of coke, and (3) holding the already formed coke at a temperature above 750° F.

THE INVENTION

According to this invention an aromatic mineral oil feedstock is heated to an elevated temperature and is subjected to low temperature delayed coking at a temperature lower than the normal coking temperature for a period of time to provide a desired level of coke in the coking drum, after which additional aromatic mineral oil capable of forming coke admixed with a non.coking material is introduced to the coking drum and subjected to delayed coking conditions for a period of time sufficient to convert unconverted feedstock to coke. The contents of the coking drum are then subjected to a heat soak at an elevated temperature, preferably greater than the initial coking temperature, whereby a premium coke having a low CTE and reduced fluff is obtained.

DETAILED DESCRIPTION OF THE INVENTION

The fresh feedstocks used in carrying out the invention are heavy aromatic mineral oil fractions. These feedstocks can be obtained from several sources including petroleum, shale oil, tar sands, coal, and the like. Specific feedstocks include decant oil, also known as slurry oil or clarified oil, which is obtained from fractionating effluent from the catalytic cracking of gas oil and/or residual oils. Another feedstock which may be employed is ethylene or pyrolysis tar. This is a heavy aromatic mineral oil which is derived from the high temperature thermal cracking of mineral oils to produce olefins such as ethylene. Another feedstock is vacuum resid which is a heavy residual oil obtained from flashing or distilling a residual oil under a vacuum. Still another feedstock is vacuum gas oil which is a lighter material obtained from flashing or distillation under vacuum. Thermal tar may also be used as a feedstock. This is a heavy oil which is obtained from fractionation of material produced by thermal cracking of gas oil, decant oil or similar materials. Heavy premium coker gas oil is still another feedstock and is the heavy oil obtained from liquid products produced in the coking of oils to premium coke. Gas oil from coking operations other than premium coking may also be employed as a feedstock. Virgin atmospheric gas oil may also be used as a feedstock. This is gas oil produced from the fractionation of crude oil under atmospheric pressure or above. Another feedstock which may be used is extracted coal tar pitch. Any of the preceding feedstocks may be used singly or in combination. In addition, any of the feedstocks may be subjected to hydrotreating, heat soaking, thermal cracking, or a combination of these steps, prior to their use for the production of premium grade coke.

Figure 1:
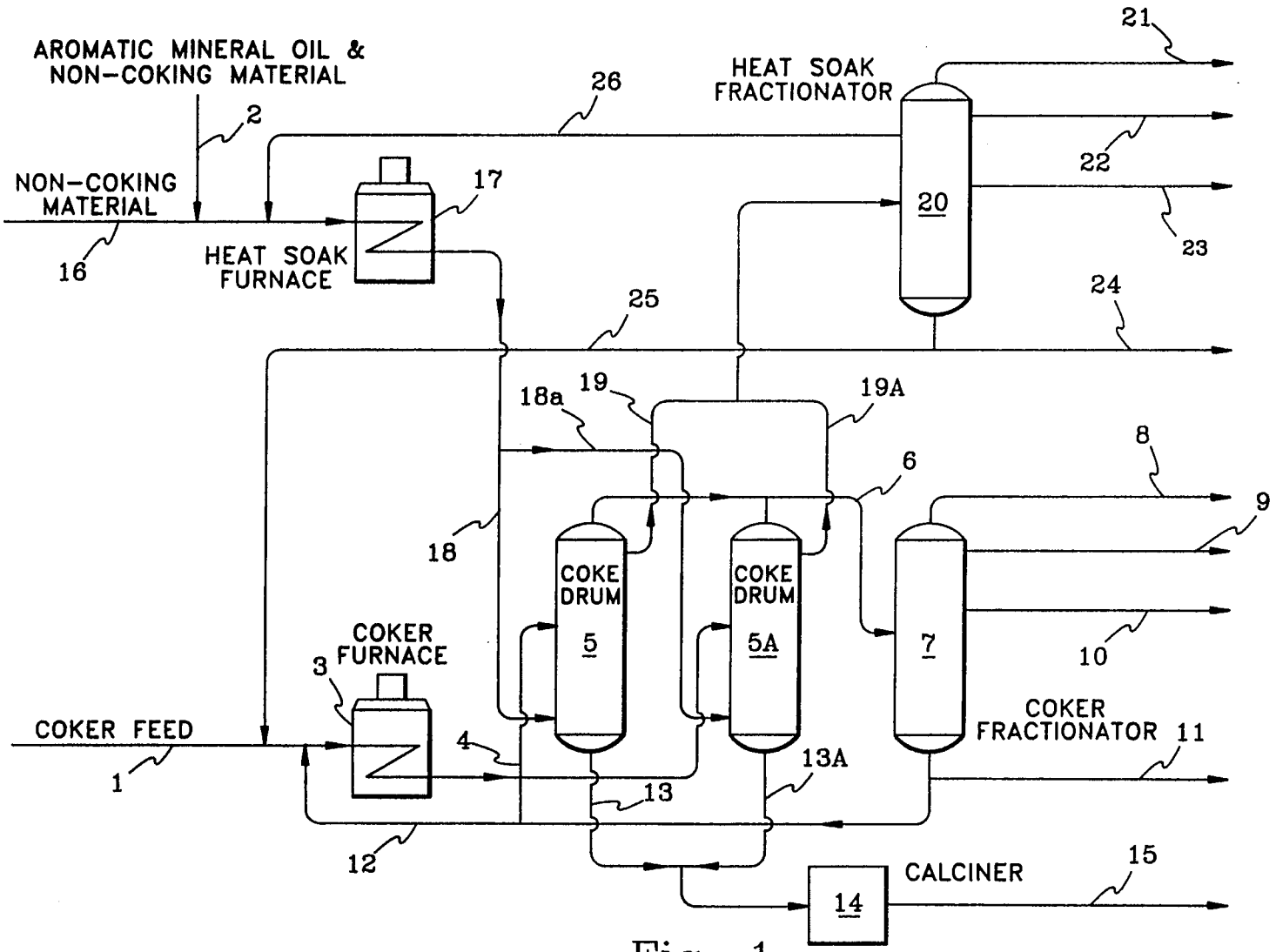
FIG. 1 is a schematic flow diagram which illustrates the invention.

Referring now to FIG. 1, feedstock is introduced to the coking process via line 1. The feedstock which in this instance is a thermal tar is heated in furnace 3 to temperatures preferably between about 800° F. and about 950° F. A furnace that heats the thermal tar rapidly to such temperatures such as a pipe still is normally used. Heated thermal tar exits the furnace at substantially the above indicated temperatures and is introduced through line 4 into the bottom of coke drum 5 which is maintained at a pressure of between about 15 and about 200 psig. The coke drum operates at a temperature below the temperature at which delayed premium coking is usually carried out, which is between about 840° F. and about 910° F. The particular temperature employed in the conventional delayed coke process will depend on the feedstock used, the time period allowed for the coking operation and the desired properties of the coke product, e.g. coke CTE.

The coke drum temperature in the process of the invention is usually maintained at between about 15° F. and about 60° F. below the temperature of the conventional process, usually in the range of about 780 to about 895° F. and more usually between about 800° F. and about 880° F. Inside the drum the heavy hydrocarbons in the thermal tar crack to form cracked vapors and premium coke.

The vapors are continuously removed overhead from the drum through line 6. Coke accumulates in the drum until it reaches a predetermined level at which time the feed to the drum is shut off. This initial coking cycle may require between about 10 and about 80 hours, but more usually is completed in about 16 to about 50 hours.

Following this operation a mixture of aromatic mineral oil and a non-coking material is introduced to the coke drum. This mixture may be provided through the same system as the coker feed namely through line 1 and furnace 3. However, in order to provide for continuous operation of the coke drums, it is desirable to introduce the mixture of aromatic mineral oil and non-coking material to the unit through line 2, heat soak furnace 17 and line 18. When using the latter procedure, the mixture leaving heat soak furnace 17 is increased to a sufficient temperature to convert the aromatic mineral oil contained therein to coke in the coke drum. This temperature may be the same as that maintained in the coke drum during the introduction of the coker feed, or it may be as high as the temperature of the subsequent heat soak, or the temperature may be maintained between the coke drum temperatures during the initial coking and the heat soak step. The flow of the mixture of aromatic mineral oil and non-coking material to the coke drum is continued until the unconverted coke feed and partially formed mesophase in the coke drum are converted to solid coke. At this point, the mixture of aromatic mineral oil and non.coking material is discontinued. The vapor flow rate in the coke drum during this step of the process is sufficiently low, due to the presence of the aromatic mineral oil, that foaming of liquid material in the coke drum is minimized.

The thermal tar which is used as the feedstock in the initial coking cycle may also be used in the mixture with the non-coking material. However, any of the aromatic mineral oils previously described may be used in this step of the process. The conversion of unconverted feed and partially formed mesophase to coke may require between about 1 and about 12 hours, but more usually is completed in about 2 to 8 about hours. The time required of course will vary with the temperature level which is maintained in the coker during this step of the process. The non-coking material which is used in admixture with the aromatic mineral oil may be any of the materials subsequently described in the discussion of the heat soak step of the process. The concentration of the aromatic mineral oil in the mixture with the non-coking material may be varied from about 5 to about 90 percent and preferably is between about 20 and 40 percent.

Prior to removing coke product from coke drum 5, the coke contained therein is subjected to a heat soak which is effected by a non-coking material which is introduced to the unit through line 16. This material is heated in heat soak furnace 17 and passed from the heat soak furnace as a vapor through line 18 into the bottom of the coke drum. Sufficient heat is provided in the non-coking material to maintain the coke drum at the desired temperature during the heat soak operation. The heat soak material exits from the top of the coke drum through line 19 and is introduced to heat soak fractionator 20. The vapor stream entering fractionator 20 contains not only the heat soak material but also lighter and heavier materials released from the coke during the heat soak operations. Within fractionator 20 the vapors are fractioned into a Cl −C3 product stream 21, a gasoline stream 22, a heavy gas oil stream 23, and a still heavier gas oil which is removed from the fractionator via line 24. If desired, a portion of the latter material may be combined with the feed to the coker.

Any material which is non-coking and does not affect the properties of the premium coke may be used as ths heat soak material. For example, the heat soak material may be a liquid hydrocarbon fraction or a normally gaseous material such as light hydrocarbons, nitrogen, steam or the like. Usually a light hydrocarbon oil, such as a distillate or a light gas oil will be employed since these materials are readily available and are unaffected by the heat soak temperature. In this instance, a light gas oil is used as the heat soak material. If desired, it may be recovered from the heat soak fractionator and recycled to the heat soak furnace through line 26. The same material or another fraction from fractionator 20 may be used for admixing with the aromatic mineral oil as previously described.

The heat soak portion of the process of the invention is carried out at an elevated temperature, usually equal to or greater than the initial coking temperature. Depending on the coking conditions employed, the aromatic mineral oil feed material used in the process, and the periods of time employed for each of the steps of the process it is possible to carry out the heat soak over a wide range of temperatures, which may even include temperatures below the initial coking temperature.

The temperature employed in the heat soak step is preferably greater than the initial coking temperature, usually from about 20 to about 60° F. greater, and varies from about 800° F. to about 955° F., and more usually from about 825° F to about 925° F. The heat soak operation normally will be carried out over a time period of between about 10 and about 60 hours and preferably from about 16 to about 50 hours. The particular time employed will depend on the feedstock used in the two coking operations, the times of coking and the coking temperatures and the heat soak temperature.

When carrying out the coking process as described herein, it is possible to operate the coke drum at lower than ordinary initial coking temperatures and at the same time obtain a product having improved physical properties, in particular a product containing less fluff and having lower CTE values.

Returning now to FIG. 1, vapors that are taken overhead from the coke drums in the coking operations are carried by line 6 to a coker fractionator 7. As shown in the drawing, the vapors will typically be fractionated into a C1 -C3 product stream 8, a gasoline product stream 9, a heavy gas oil product stream 10, and a premium coker heavy gas oil taken from the fractionator via line 11.

As indicated previously, the premium coker heavy gas oil from the fractionator may be recycled at the desired ratio to the coker furnace through line 12. Any excess net bottoms may be subjected to conventional residual refining techniques if desired.

As described previously in the initial coking step coke accumulates in drum 5 until it reaches a predetermined level at which time the aromatic mineral oil feed to the drum is shut off. At this point the feed is switched to a second drum **5*a* wherein the same operation is carried out. This switching permits drum 5** to be taken out of service after the additional coking and heat processing steps are completed. The drum can then be opened and the accumulated green coke can be removed therefrom using conventional techniques.

As shown in FIG. 1, green coke is removed from coke drums 5 and **5*a* through outlets 13 and 13*a* respectively, and introduced to calciner 14 where it is subjected to elevated temperatures to remove volatile materials and to increase the carbon to hydrogen ratio of the coke. Calcination may be carried out at temperatures in the range of between about 2000° F. and about 3000° F. but preferably calcining is done at temperatures between about 2400° F. and about 2600° F. The coke is maintained under calcining conditions for between about 0.5 and about 10 hours and preferably between about 1 hour and about 3 hours. The calcining temperature and time of calcining will vary depending on the properties desired in the final coke product. Calcined premium coke reduced in fluff and having a low CTE which is suitable for the manufacture of large graphite electrodes is withdrawn from the calciner through outlet 15**.

The invention has been described as utilizing both a coker fractionator and a heat soak fractionator. It is within the scope of the invention however to carry out both operations in a single fractionator, in which event the effluent from the coke drums during both coking and heat soak would be fed to this fractionator. All of the streams normally recovered from the two fractionators would then be obtained from the single fractionator.

The process, as illustrated in FIG. 1, is carried out in two coke drums and the heat requirements of the process are supplied by two furnaces. Depending on the time periods during which the various steps of the process are carried out. It may be desirable to use additional coke drums and furnaces in order to provide for continuous operation of the process. For example, a separate furnace may be provided for heating the heat soak material.

The following examples illustrate the results obtained in carrying out the invention.

EXAMPLE 1

Runs 1 to 8 were conducted using a small delayed coker with a coke drum. Coke drum temperatures were maintained using a 3-zone electrical resistance clam shell heater.

The green coke was removed from the coke drum and segregated into fluff, top, middle and bottom sections. Properties of the separated green coke samples were determined prior to batch calcination at 2600° F. Apparent densities of the green coke were determined by cutting and weighing cubes of known volume out of each section. The calcined coke sections were tested by various methods before being composited for production of a ¾" graphitized artifact. The calcined coke composite was mixed with coal tar pitch and iron oxide, extruded, baked at about 900° C. and then graphitized at about 3000° C. The graphitized artifact was made either with all −200 mesh coke or a coarse grain mix containing −200 mesh flour, 20/35 mesh, 8/14 mesh, and 3/6 mesh particles.

The feedstock was a thermal tar and the non-coke forming heat soak material (distillate) was a blend of a FCC light cycle oil (20 wt%) and a light premium coker gas oil (80 wt%). These streams are typical of those which might be used in the industry as feed for premium coke and for heat treating. The properties of the feedstock, the heat soak materials, and the admixtures of feedstock and heat soak material used in this Example and in Example 2 are tabulated in Table 1.

TABLE 1

| Sample Description | Thermal Tar | Distillate | Heavy Premium Coker Gas Oil | 20% Dist & 80% Tar Blend | 30% Dist & 70% Tar Blend |
|---|---|---|---|---|---|
| API Gravity | −1.3 | 11.4 | −3.6 | 8.3 | 7.0 |
| Specific Gravity, | 1.087 | 0.990 | 1.106 | 1.012 | 1.022 |
| Distillation Type | D-1160 | D-2887 | D-2887 | D-2887 | D-2887 |
| IBP, °F. | | 284 | 396 | 282 | 298 |
| 5 vol % | 588 | 386 | 587 | 399 | 406 |
| 10 | 634 | 422 | 624 | 443 | 447 |
| 20 | 653 | 460 | 653 | 479 | 486 |
| 30 | 680 | 488 | 671 | 505 | 516 |
| 40 | 712 | 512 | 690 | 534 | 545 |
| 50 | 741 | 538 | 708 | 550 | 577 |
| 60 | — | 554 | 727 | 580 | 607 |
| 70 | — | 579 | 747 | 606 | 645 |
| 80 | — | 603 | 772 | 644 | 696 |
| 90 | — | 633 | 805 | 711 | 775 |
| 95 | — | 660 | 837 | 784 | 844 |
| Endpoint, °F. | 741 | 770 | 931 | 948 | 995 |
| % Recovered | 50 | — | — | — | — |
| Sulfur, wt % | 0.43 | 0.13 | 0.61 | 0.19 | 0.21 |
| Nitrogen, wt % | 0.24 | 0.03 | 0.31 | — | 0.12 |
| Hydrogen, Total [H-NMR], wt % | 8.85 | 8.42 | 6.67 | 8.22 | 8.01 |
| Hydrogen Type, % | | | | | |
| Methyl | 7.6 | 6.9 | 1.9 | 7.8 | 6.8 |
| Methylene | 16.7 | 17.5 | 7.2 | 18.2 | 17.0 |
| Naphthenic | 9.8 | 7.9 | 3.6 | 6.2 | 7.3 |
| Alpha | 30.4 | 32.6 | 35.7 | 31.5 | 31.1 |
| Aromatic | 35.2 | 34.9 | 51.7 | 36.3 | 37.4 |
| Olefinic | 0.0 | 0.2 | 0.0 | 0.0 | 0.5 |
| Aromatic Carbon, wt % | 71.8 | 65.1 | 81.3 | 69.4 | 67.4 |
| Carbon Residue, wt % | | | | | |
| Alcor | 6.39 | 0.07 | 0.77 | — | 1.95 |
| Ramsbottom | — | 0.80 | 1.41 | 1.42 | 1.21 |
| Viscosities, cs | | | | | |
| 40° C. | 160.55 | 3.07 | 60.10 | — | — |
| 50° C. | 42.13 | 2.48 | 30.43 | — | — |
| 100° C. | 7.43 | 1.02 | 4.65 | — | — |
| CHNPE, wt % | | | | | |
| Carbon | 91.7 | 89.9 | 91.9 | 90.4 | 90.3 |
| Hydrogen | 7.4 | 8.5 | 7.1 | 8.2 | 8.1 |
| Nitrogen | 0.2 | 0.1 | 0.4 | 0.2 | 0.2 |
| Watson K Factor | 9.81 | 10.08 | 9.56 | 9.92 | 9.98 |

The results of runs 1 to 8 are set forth in Table 2.

TABLE 2

| Run Number | 1 | 2 | 3 | 4 | 5 | 6 | 7* | 8** |
|---|---|---|---|---|---|---|---|---|
| Fill Cycle, hrs | 42 | 32 | 32 | 32 | 32 | 32 | 24 | 24 |
| Avg. Coke (Wt'd) Temp., °F. | 904 | 878 | 876 | 875 | 876 | 875 | 878 | 879 |
| Drum Vapor Temp., °F. | 887 | 860 | 860 | 859 | 862 | 866 | 863 | — |
| Mixture of Thermal Tar and Distillate Temp. | — | — | — | — | — | — | 878 | 879 |
| Heat Soak Cycle, hrs | — | 16 | 16 | 16 | 13 | 16 | 18 | 16 |
| Avg. Coke (Wt'd) Temp. °F. | — | 904 | 902 | 900 | 899 | 900 | 903 | 903 |
| Drum Vapor Temp., °F. | — | 882 | 881 | 882 | 871 | 882 | 878 | — |
| Green Coke Properties | | | | | | | | |
| Extent of Fluffing, wt % | 0.0 | 12.2 | 3.8 | 0.0 | 0.0 | 0.0 | 0.0 | 0.0 |
| Insitu Density, gr/cc | 1.01 | 0.91 | 0.98 | 1.02 | 0.99 | 0.97 | 0.91 | 1.05 |
| Apparent Density, gr/cc | | | | | | | | |
| Fluff | — | 0.655 | 0.785 | — | — | — | — | 0.796 |
| Top | 1.043 | — | 0.996 | 1.063 | 1.098 | 1.098 | 1.006 | 1.062 |
| Middle | 1.043 | 1.034 | 1.094 | 1.078 | 1.070 | 1.127 | 1.069 | 1.071 |
| Bottom | 1.043 | 1.049 | 1.05 | 1.062 | 1.044 | 1.107 | 1.124 | 1.064 |
| Volatile Matter, | | | | | | | | |

TABLE 2-continued

| Run Number | 1 | 2 | 3 | 4 | 5 | 6 | 7* | 8** |
|---|---|---|---|---|---|---|---|---|
| wt % | | | | | | | | |
| Fluff | — | 8.0 | 8.8 | — | — | — | — | — |
| Top | 11.9 | — | 10.6 | 9.5 | 8.0 | 9.6 | 4.9 | 6.3 |
| Middle | 8.5 | 8.1 | 8.5 | 7.2 | 7.0 | 8.6 | 4.6 | 5.8 |
| Bottom | 7.5 | 7.6 | 7.7 | 8.2 | 6.7 | 7.9 | 4.6 | 5.3 |
| Crush Index, % | | | | | | | | |
| Fluff | — | — | 39.4 | — | — | — | — | — |
| Top | 33.1 | — | — | 33.4 | 35.8 | 45.7 | 40.0 | 40.0 |
| Middle | 48.8 | 48.6 | 45.1 | 44.5 | 45.8 | 49.6 | 51.2 | 54.2 |
| Bottom | 61.4 | 56.7 | 53.6 | 55.6 | 54.7 | 53.2 | 56.8 | 59.8 |
| Calcined Coke Properties | | | | | | | | |
| Sulfur, wt % | | | | | | | | |
| Fluff | — | 0.33 | 0.41 | — | — | — | — | — |
| Top | 0.37 | — | — | — | 0.33 | — | — | 0.31 |
| Middle | 0.37 | 0.34 | 0.35 | — | 0.33 | 0.33 | — | 0.31 |
| Bottom | 0.35 | 0.34 | 0.36 | — | 0.33 | 0.34 | — | 0.31 |
| VBD (3/6 mesh), gr/cc | | | | | | | | |
| Fluff | — | 0.61 | 0.76 | — | — | — | — | — |
| Top | 0.73 | — | — | 0.70 | 0.76 | 0.75 | 0.75 | 0.76 |
| Middle | 0.84 | 0.82 | 0.84 | 0.87 | 0.82 | 0.83 | 0.80 | 0.79 |
| Bottom | 0.82 | 0.84 | 0.82 | 0.83 | 0.82 | 0.80 | 0.81 | 0.79 |
| Composite | 0.83 | 0.84 | 0.84 | 0.83 | 0.81 | 0.82 | 0.81 | 0.80 |
| X-ray CTE $\times 10^{-7}$ | | | | | | | | |
| Fluff | — | 1.6 | 4.6 | — | — | — | — | — |
| Top | 1.6 | — | 3.1 | 1.6 | 1.7 | 1.6 | 1.0 | 1.2 |
| Middle | 1.3 | 1.0 | 1.2 | 1.5 | 1.6 | 1.3 | 1.2 | 1.4 |
| Bottom | 1.3 | 1.0 | 1.2 | 1.2 | 1.3 | 1.1 | 1.0 | 1.0 |
| ¾ inch Rod CTE $\times 10^{-7}$ | | | | | | | | |
| Flour (All Sections) | 2.8 | 2.2 | 2.7 | 2.9 | 3.1 | 2.9 | 2.2 | 2.7 |
| Coarse Grain | 7.7 | 6.7 | 8.0 | — | — | — | — | — |

*Mixture of thermal tar and distillate introduced to coker for six hours.
**Mixture of thermal tar and distillate introduced to coker for eight hours. Temperature increased gradually from 879 to 903 during last two hours.

Referring to Table 2, Run 1 is an illustrative standard premium coke run which is provided for comparison with the succeeding runs. Run 2 was carried out at a lower coking temperature for a shorter period of time, and was followed by a heat soak step of lesser duration than the coking run, but at a temperature above the coking temperature. The non.coke forming material used in the heat soak step was the distillate shown in Table 1. The coke CTE of the ¾inch graphitized artifact and the x-ray CTE of the material produced in Run 2 were somewhat lower than those of Run 1. It should be noted however, that Run 2 produced 12.2 weight percent fluff coke which had an apparent density of .655 gr/cc which is about 0.3 gr/cc less than the coke from the middle and bottom sections of the coker. This would present a significant problem in a commercial operation because this coke would have to be segregated from the dense coke to prevent problems during electrode manufacture.

Run 3 was carried out in a manner similar to Run 2 except that heavy premium coker gas oil was used as the sole component in the heat soak portion of the run. It is noted that the densities of the green coke (apparent density) and the calcined coke vibrated bulk (VBD) are all higher than Run number 2 and in some cases higher than those in Run 1. The coke from the top of the coke drum had a higher sulfur content and x-ray CTE than in either Run 1 or Run 2. This type of operation would also require segregation of the coke and complicate the commercial operation.

In Run 4, thermal tar was used both in the coking cycle and as the heat soak material. The green coke apparent densities obtained in this run are very good, but the green coke volatile matter and crush index values suggest that the coke at the very top of the drum was not completely formed. The calcined coke VBD of the top section supports this conclusion. Also the coke CTE's obtained in this run are higher than in Run 2.

In Run 5 a 70/30 blend of distillate and thermal tar was used in the heat soak cycle. In Run 6 the blend was 50/50 distillate and thermal tar. It is noted from the table that the production of low density fluff coke in these runs is drastically reduced particularly as compared to Run 2, and is substantially eliminated for all practical purposes. However, the procedure used in these runs produced coke which had higher CTE's than the coke obtained in Run 1.

In Run 7 after the initial coking cycle, an 80/20 mixture of distillate and thermal tar was introduced to the coker at the same temperature for a period of six hours. Thereafter, a heat soak was carried out in the presence of distillate only at an increased temperature as shown in Table 2. Run 8 corresponded to Run 7 except that in Run 7 the temperature was increased immediately after the switch to 100% distillate, and in 8 the temperature was gradually increased over a period of two hours. It is noted that some lower density coke was evident at the very top of the drum in Run 8. There was so little however that it could not be accurately measured. It was obviously a very small amount since the green coke insitu density of Run 8 was 1.05 gr/cc as compared to 0.91 gr/cc for Run 7. It is noted that the coke product obtained in Runs 7 and 8 has a lower CTE than the coke from the standard coking operation of Run 1.

EXAMPLE 2

A larger scale test run was carried out using a thermally cracked residual oil during the coking step followed by a higher temperature heat soak cycle using the distillate of Table 1. Examination of the contents of the coker after the run showed that a light "fluff" type coke with little needlelike structure and low VBD was produced. The fluff material was found throughout the coke drum with most of it in the top 10 to 15 feet.

Figure 2:
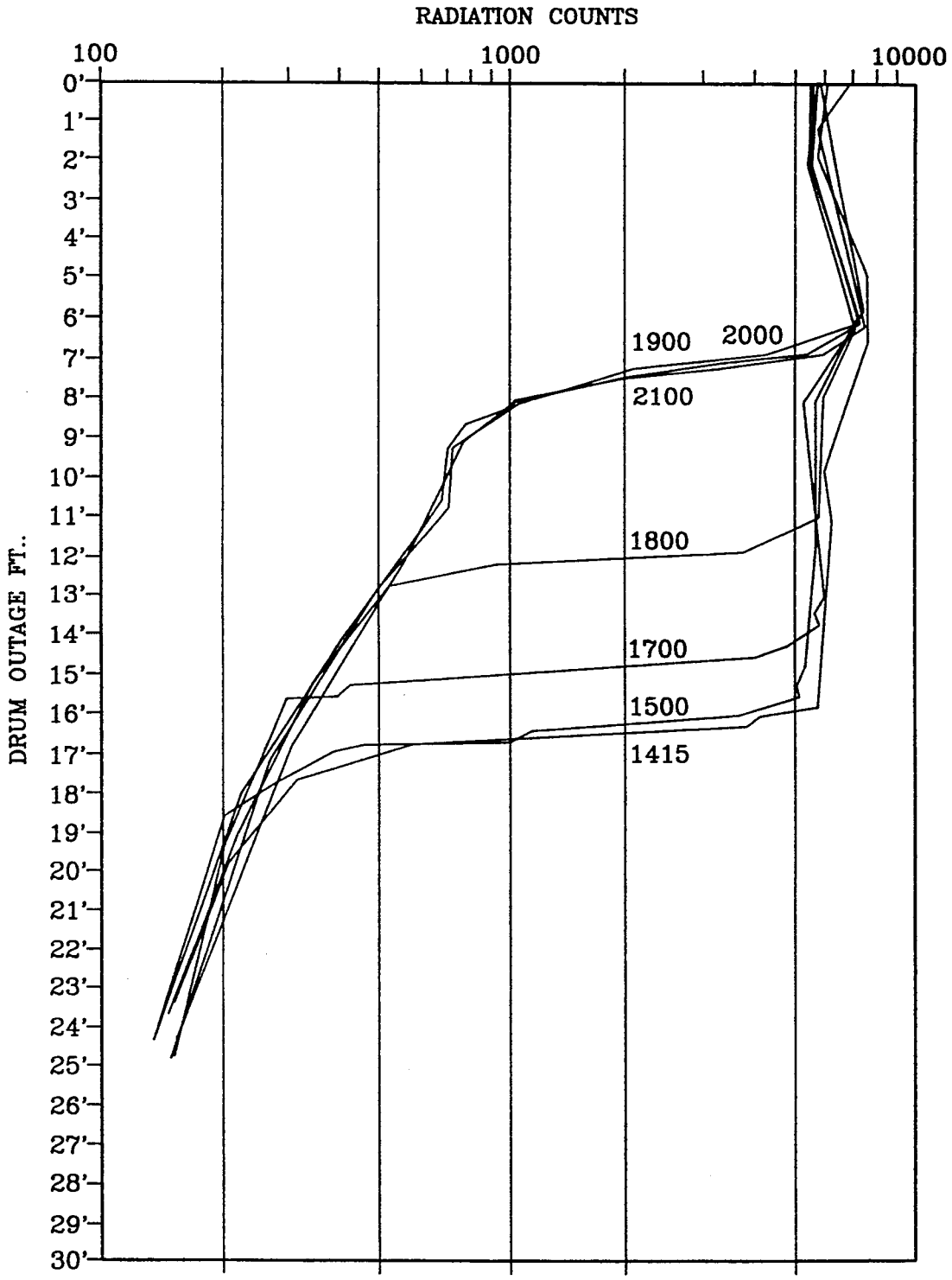
FIGS. 2 and 3 are graphs of drum outage vs. gamma ray scans of a coke drum during a coking operation.
Figure 3:
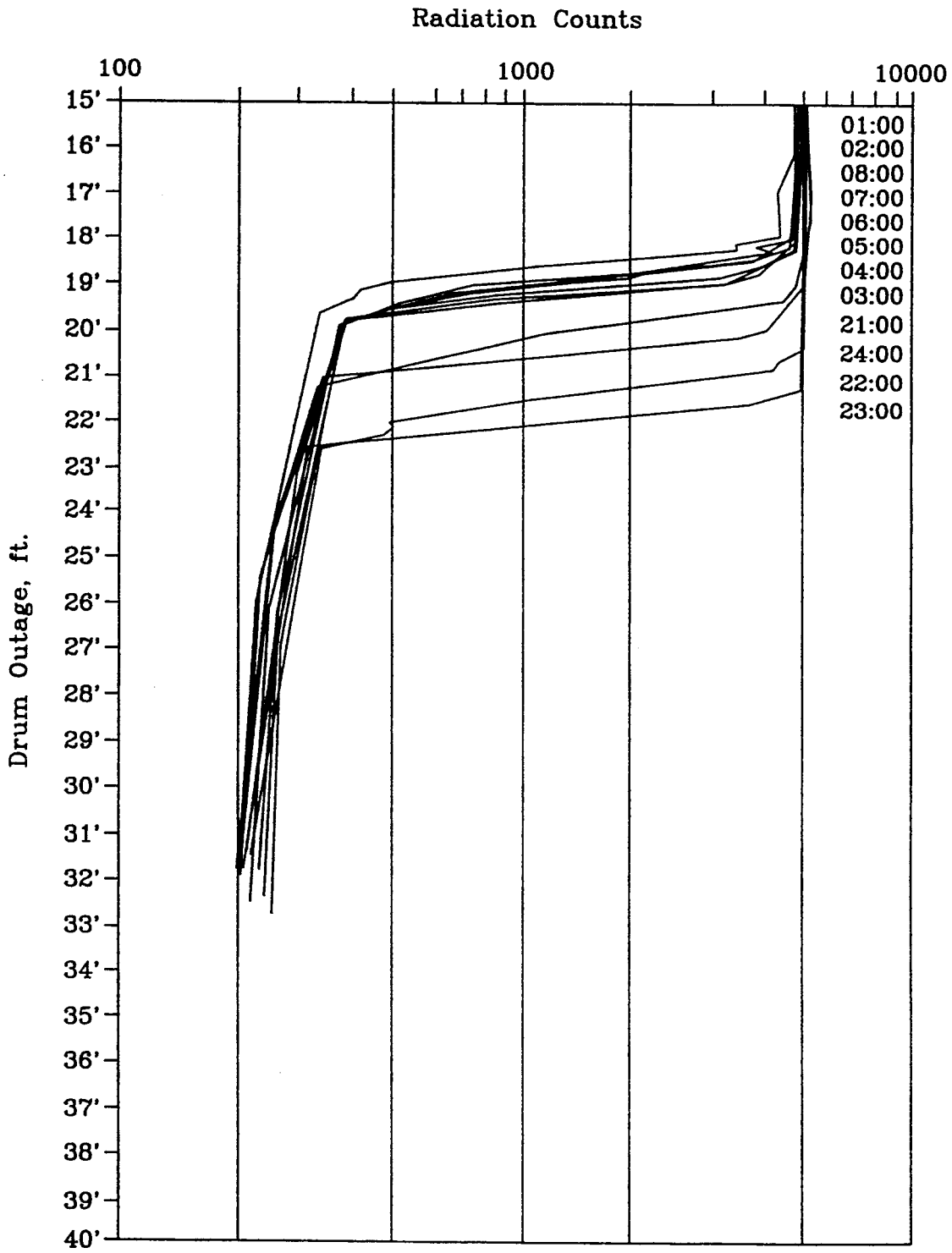

A graphic representation of the density changes (fluffing process) occurring in the coke drum during the run is shown in FIG. 2. The data in FIG. 2 was obtained by taking a gamma ray scan of the coke drum at different time intervals during the coking and heat soak cycles. The relative insitu densities of the coke in the drum were determined by measuring the amount of radiation passing through the drum at different levels.

The drum scans were taken every one to two hours. Hours 1400 to 1500 during the coking cycle shows dense coke being formed (that is, 200 radiation counts on a scale of 100–10,000), with a 1 to 2 foot layer of less dense pitch material at the top. At 1600 hours the coking cycle was completed and the feed to the coke drum was switched to the distillate. At this point, even with 100% non-coke forming material, the coke level in the drum continued to increase. Three hours after the switch to non-coke forming distillate (1900 hours) the level in the coke drum had increased by 10 feet since the end of the coking cycle. This 10 feet of material is less dense as demonstrated by the number of radiation counts (900 on a scale of 100–10,000) than the coke formed during the coking cycle. When the coke was cut out of the coke drum, this material was segregated from the main coke bed and observed to be fluff coke. Calcination of this material produced a coke with a very low 3/6 mesh VBD of 0.65 gr/cc and very poor needle-like character.

EXAMPLE 3

Another larger scale test run was carried out (similar to Run 8 of Example 1) except that the heat soak material used was a 70/30 blend of distillate and tar rather than an 80/20 blend.

FIG. 2 shows the summary drum scan of the coke drum during this run. Hour 2100 shows the end of the coking cycle at a 21 foot outage with only 2 to 3 feet of additional coke formation during the heat soak cycle. The additional 2 to 3 feet of coke was formed from the thermal tar contained in the feed to the coker used during the heat soak step. The amount of fluffing as compared to Example 2 was significantly reduced using this type of operation. The process employed in Example 3 improved the calcined coke 3/6 mesh VBD from 0.65 gr/cc to 0.75 gr/cc as compared to the coke produced in Example 2. Also, the coke CTE's of the coke in the top portion of the coke drum in Example 3 were as low as those of the coke produced in the rest of the coke drum.

The invention has been described primarily by reference to the preferred embodiment in which the process is carried out in three steps. In the first step an aromatic mineral oil is subjected to delayed coking at a temperature which is less than the temperature normally employed in the coking process. In the second step a feed material which is an admixture of an aromatic mineral oil capable of forming coke and a non.coking material is introduced to the coking drum for a period of time at a temperature equal to or above the initial coking temperature. In the third step, the coke in the coke drum is contacted with a non.coking material at a temperature above the initial coking temperature. It is within the scope of the invention, however, to carry out the process without the use of the third step or heat soaking step. When this latter two step procedure is employed the coke obtained usually is less desirable than the coke from the three step process. For example, it ordinarily has a higher CTE than coke obtained from the three step process. In those instances where a higher CTE is suitable for the intended use of the coke, or where it is desirable to manufacture a lower grade coke such as an aluminum grade coke where CTE is not significant to the quality of the coke, the two step process may be employed.

If the heat soak step is not used, a greater time period up to about 20 hours may be required for the second step of the process, and in addition a higher temperature may also be required for this step. The temperature used in the second step however, usually will not be greater than the temperature which is preferably employed in the heat soak step of the three step process.

The three step process of the invention provides an improvement over the conventional delayed premium coking process in that it produces a coke product leaving a lower CTE value. Both the three step and the two step processes of the invention are advantageous as compared to a procedure in which coking is followed by a heat soak using only a non.coking material in tbat the product coke obtained contains substantially less fluff.

While certain embodiments and details have been shown for the purpose of illustrating the present invention, it will be apparent to those skilled in the art, various changes and modifications may be made herein without departing from the spirit or scope of the invention.

We claim:

1. In a delayed premium coking process in which an aromatic mineral oil feedstock is heated to elevated temperature and introduced continuously to a coking drum under delayed coking conditions wherein the heated feedstock soaks in its contained heat to convert the feedstock to cracked vapors and premium coke at lower than normal coking temperatures in the range of about 780° F. to about 895° F. and in which the introduction of feedstock to the coking drum is discontinued after the coking drum is filled to a desired level, the improvement which comprises introducing additional aromatic mineral oil capable of forming coke admixed with a non-coking material to the coking drum under delayed coking conditions for a sufficient period of time to convert unconverted liquid material to coke wherein the concentration of aromatic mineral oil in the admixture is from 5 to 90 percent, and thereafter subjecting the contents of the coke drum to a heat soak at a temperature greater than the initial coking temperature whereby a premium coke having improved CTE and reduced fluff is obtained.

2. The process of claim 1 in which the aromatic mineral oil feedstock is selected from the group consisting of decant oil, pyrolysis tar, vacuum resid, vacuum gas oil, thermal tar, heavy premium coker gas oil, virgin atmospheric gas oil and extracted coal tar pitch.

3. The process of claim 2 in which the unconverted liquid material is converted to coke at the initial coking temperature.

4. The process of claim 2 in which the unconverted liquid material is converted to coke at a temperature intermediate the initial coking temperature and the heat soak temperature.

5. The process of claim 2 in which the unconverted liquid material is converted to coke at the heat soak temperature.

6. The process of claim 2 in which the additional aromatic mineral oil is the same as the initial aromatic mineral oil feedstock.

7. The process of claim 2 in which the additional aromatic mineral oil is different from the initial aromatic mineral oil feedstock.

8. A delayed premium coking process operated at lower than normal coking temperatures in which an aromatic mineral oil feedstock is heated to between about 830° F. and about 950° F. and introduced continuously to a coking drum wherein the heated feedstock soaks in its contained heat at a temperature between about 780° F. and about 895° F. and a pressure between about 15 psig and about 200 psig for a period of time sufficient to convert the major portion of the feedstock to cracked vapors and premium coke, the introduction of feedstock to the coking drum is discontinued after the coking drum is filled to a desired level, additional aromatic mineral oil capable of forming coke admixed with a non-coking material oil is introduced to the coking drum under delayed coking conditions for a time period sufficient to convert unconverted liquid material to coke and thereafter the contents of the coke drum are subjected to a heat soak in the presence of a non-coking material at a temperature greater than the initial coking temperature, between 800° F. and about 955° F., whereby a premium coke having improved CTE and reduced fluff is obtained.

9. The process of claim 8 in which the unconverted liquid material is converted to coke at the initial coking temperature.

10. The process of claim 8 in which the unconverted liquid material is converted to coke at a temperature intermediate the initial coking temperature and the heat soak temperature.

11. The process of claim 8 in which the unconverted liquid material is converted to coke at a heat soak temperature.

12. The process of claim 8 in which the initial coking is carried out for a time period of between about 10 and about 80 hours, the convertsion of unconverted liquid material is coke to effected for a time period of between about 1 to about 12 hours and the heat soak is carried out for a time period of between about 10 and about 60 hours.

13. The process of claim 12 in which the aromatic mineral oil feedstock is selected from the group consisting of decant oil, pyrolysis tar, vacuum resid, vacuum gas oil, thermal tar, heavy premium coker gas oil, virgin atmospheric gas oil and extracted coal tar pitch.

14. The process of claim 13 in which the aromatic mineral oil feedstock is a thermal tar, the aromatic mineral oil used in converting the unconverted feed to coke is the same thermal tar and the non-coking material is a light hydrocarbon oil.

15. The process of claim 14 in which the mixture of thermal tar and light hydrocarbon oil contains from about 5 to about 90 weight percent thermal tar.

16. In a delayed premium coking process in which an aromatic mineral oil feedstock is heated to elevated temperature and introduced continuously to a coking drum under delayed coking conditions wherein the heated feedstock soaks in its contained heat to convert the feedstock to cracked vapors and premium coke at lower than normal coking temperatures in the range of about 780° F. to about 895° F. and in which the introduction of feedstock to the coking drum is discontinued after the coking drum is filled to a desired level, the improvement which comprises introducing additional aromatic mineral oil capable of forming coke admixed in a concentration of from 5 to 90 percent with a on-coking material to the coking drum and maintaining the coking drum at a temperature greater than the initial coking temperature to convert unconverted liquid material to coke whereby a coke having reduced fluff is obtained.

17. In a delayed premium coking process in which an aromatic mineral oil feedstock is heated to elevated temperature and introduced continuously to a coking drum under delayed coking conditions wherein the heated feedstock soaks in its contained heat to convert the feedstock to cracked vapors and premium coke at lower than normal coking temperatures in the range of about 780° F. to about 895° F. and in which the introduction of feedstock to the coking drum is discontinued after the coking drum is filled to a desired level, the improvement which comprises introducing additional aromatic mineral oil capable of forming coke admixed with a non-coking material in a concentration of from 5 to 90 percent to the coking drum under delayed coking conditions for a sufficient period of time to convert unconverted liquid material to coke, and thereafter subjecting the contents of the coke drum to a heat soak at an elevated temperature whereby a premium coke having improved CTE and reduced fluff is obtained.

18. The process of claim 17 in which the aromatic mineral oil feedstock is selected from the group consisting of decant oil, pyrolysis tar, vacuum resid, vacuum gas oil, thermal tar, heavy premium coker gas oil, virgin atmospheric gas oil and extracted coal tar pitch.

19. The process of claim 18 in which the unconverted liquid material is converted to coke at the initial coking temperature and the heat soak is carried out at the initial coking temperature.

20. A delayed premium coking process operated at lower than normal coking temperatures in which an aromatic mineral oil feedstock is heated to between about 830° F. and about 950° F. and introduced continuously to a coking drum wherein the heated feedstock soaks in its contained heat at a temperature between about 780° F. and about 895° F. and a pressure between about 15 psig and about 200 psig for a period of time sufficient to convert the major portion of the feedstock to cracked vapors and premium coke, the introduction of feedstock to the coking drum is discontinued after the coking drum is filled to a desired level, additional aromatic mineral oil capable of forming coke admixed with a non-coking material oil is introduced to the coking drum under delayed coking conditions for a time period sufficient to convert unconverted liquid material to coke and thereafter the contents of the coke drum are subjected to a heat soak in the presence of a non-coking material at the same temperature as the initial coking temperature.

21. The process of claim 20 in which the unconverted liquid material is converted to coke at the initial coking temperature.

22. A continuous delayed premium coking process operated at lower than normal coking temperatures in which an aromatic mineral oil feedstock is heated in a first furnace to between about 830° F. and about 950° F. and introduced continuously to a coking drum wherein the heated feedstock soaks in its contained heat at a temperature between about 780° F. and about 895° F. and a pressure between about 15 psig and about 200 psig for a period of time sufficient to convert the major portion of the feedstock to cracked vapors and premium coke, the introduction of feedstock to the coking drum is discontinued after the coking drum is filled to a desired level, additional aromatic mineral oil capable of forming coke admixed with a non-coking material oil is heated in a second furnace and introduced to the coking drum under delayed coking conditions for a time period sufficient to convert unconverted liquid material to coke and thereafter the contents of the coke drum are subjected to a heat soak in the presence of a non-coking material at a temperature greater than the initial coking temperature, between about 800° F. and about 955° F., whereby a premium coke having improved CTE and reduced fluff is obtained.

23. The process of claim 22 in which furnace heat soak material is heated in the second furnace to provide heat for the heat soak step.

24. The process of claim 23 in which the feedstock is introduced to a second coking drum after being withdrawn from the first coking drum and the steps of the process are repeated in the second coking drum, whereby continuous flow of feedstock to the process is provided.

* * * * *

UNITED STATES PATENT AND TRADEMARK OFFICE

CERTIFICATE OF CORRECTION

PATENT NO. : 5,028,311

DATED : July 2, 1991

INVENTOR(S) : John K. Shigley; Keith M. Roussel; Steve D. Harris and Eric S. Johnson It is certified that error appears in the above-identified patent and that said Letters Patent is hereby corrected as shown below:

Title page, item [75]:

Inventors Should be: John K. Shigley, Ogden, Utah; Keith M. Roussel and Steve D. Harris of Ponca City, Oklahoma; and Eric S. Johnson of Lake Charles, Louisiana

Signed and Sealed this

Seventeenth Day of November, 1992

*Attest:*

DOUGLAS B. COMER

*Attesting Officer*

*Acting Commissioner of Patents and Trademarks*